US008828157B2

(12) United States Patent
Okamoto

(10) Patent No.: US 8,828,157 B2
(45) Date of Patent: Sep. 9, 2014

(54) METHOD FOR PRODUCING SHAPED ARTICLE OF ALUMINUM ALLOY, SHAPED ALUMINUM ALLOY ARTICLE AND PRODUCTION SYSTEM

(75) Inventor: Yasuo Okamoto, Kitakata (JP)

(73) Assignee: Showa Denko K.K., Tokyo (JP)

( * ) Notice: Subject to any disclaimer, the term of this patent is extended or adjusted under 35 U.S.C. 154(b) by 1199 days.

(21) Appl. No.: 10/583,040

(22) PCT Filed: Dec. 17, 2004

(86) PCT No.: PCT/JP2004/019460

§ 371 (c)(1),
(2), (4) Date: Feb. 5, 2007

(87) PCT Pub. No.: WO2005/059195

PCT Pub. Date: Jun. 30, 2005

(65) Prior Publication Data

US 2007/0144629 A1 Jun. 28, 2007

Related U.S. Application Data

(60) Provisional application No. 60/534,191, filed on Jan. 2, 2004.

(30) Foreign Application Priority Data

Dec. 18, 2003 (JP) ..... 2003-421424
Mar. 10, 2004 (JP) ..... 2004-067154

(51) Int. Cl.
*C22F 1/04* (2006.01)
*C22C 21/02* (2006.01)

(52) U.S. Cl.
USPC ..... 148/551; 148/691

(58) Field of Classification Search
USPC ..... 148/551, 691
See application file for complete search history.

(56) References Cited

U.S. PATENT DOCUMENTS 6,702,907 B2 * 3/2004 Sato et al. ..... 148/551
7,267,734 B2 * 9/2007 Evans et al. ..... 148/552

(Continued)

FOREIGN PATENT DOCUMENTS

DE 10110769 C1 * 10/2002 ..... B22D 17/00
JP 64-39339 A 2/1989

(Continued)

OTHER PUBLICATIONS

Machine translation of JP2000265232.*

(Continued)

*Primary Examiner* — Rebecca Lee
(74) *Attorney, Agent, or Firm* — Sughrue Mion, PLLC

(57) ABSTRACT

A method for producing an aluminum-alloy shaped product, includes a step of forging a continuously cast rod of aluminum alloy serving as a forging material, in which the aluminum alloy contains Si in an amount of 10.5 to 13.5 mass %, Fe in an amount of 0.15 to 0.65 mass %, Cu in an amount of 2.5 to 5.5 mass % and Mg in an amount of 0.3 to 1.5 mass %, and heat treatment and heating steps including a step of subjecting the forging material to pre-heat treatment, a step of heating the forging material during a course of forging of the forging material and a step of subjecting a shaped product to post-heat treatment, the pre-heat treatment including treatment of maintaining the forging material at a temperature of −10 to 480° C. for two to six hours.

7 Claims, 6 Drawing Sheets

(56) References Cited

U.S. PATENT DOCUMENTS

| | | | | |
|---|---|---|---|---|
| 2002/0003012 | A1 | 1/2002 | Sato et al. | |
| 2004/0261615 | A1 * | 12/2004 | Yanagimoto et al. | 92/208 |

FOREIGN PATENT DOCUMENTS

| | | | |
|---|---|---|---|
| JP | 11-335767 | A | 12/1999 |
| JP | 2000-265232 | A | 9/2000 |
| JP | 2002-294383 | A | 10/2002 |
| JP | 2003-053468 | A | 2/2003 |
| WO | WO 01/77398 | A1 | 10/2001 |

OTHER PUBLICATIONS

Translation of JP 64039339.*
Machine translation of DE 10110769, 2002.*
Machine translation of JP2000265232, 2000.*
Translation of JP 64039339, 1989.*

* cited by examiner

METHOD FOR PRODUCING SHAPED ARTICLE OF ALUMINUM ALLOY, SHAPED ALUMINUM ALLOY ARTICLE AND PRODUCTION SYSTEM

CROSS REFERENCE TO RELATED APPLICATIONS

This application is an application filed under 35 U.S.C. §111(a) claiming the benefit pursuant to 35 U.S.C. §119(e)(1) of the filing date of Provisional Application No. 60/534,191 filed Jan. 2, 2004 pursuant to 35 U.S.C. §111(b).

TECHNICAL FIELD

The present invention relates to a method for producing an aluminum-alloy shaped product, which method includes a step of forging a continuously cast aluminum alloy rod serving as a forging material, to an aluminum-alloy shaped product and to a production system for the shaped product.

BACKGROUND ART

In recent years, in vehicles such as four-wheel-drive automobiles and two-wheel-drive automobiles (hereinafter such a vehicle will be referred to simply as an "automobile"), attempts have been made to employ an aluminum-alloy forged product in an internal combustion engine piston in order to attain high performance or to cope with environmental regulations. This is because, when such an aluminum-alloy forged product is employed, the weight of driving parts (e.g., a piston) for an internal combustion engine can be reduced, leading to reduction of a load upon operation of the internal combustion engine, enhancement of output, or reduction of fuel consumption. Conventionally, most internal combustion engine pistons have been produced from an aluminum-alloy cast product. However, in the case of such a cast product, difficulty is encountered in reducing internal defects generated during the course of casting, and excess material must be provided on the cast product so as to ensure safety design in terms of strength. Therefore, when such a cast product is employed in an internal combustion engine piston, reducing the weight of the piston is difficult. In view of the foregoing, attempts have been made to reduce the weight of such a piston by producing the piston from an aluminum-alloy forged product, in which generation of internal defects can be suppressed.

A conventional method for producing an aluminum-alloy forging material includes a step of preparing molten aluminum alloy by means of a typical smelting technique, a step of subjecting the molten aluminum alloy to any continuous casting technique, such as continuous casting, semi-continuous casting (DC casting) or hot top casting, to thereby produce an aluminum-alloy cast ingot and a step of subjecting the cast ingot to homogenization heat treatment to thereby homogenize aluminum alloy crystals. The thus produced aluminum-alloy forging material (cast ingot) is subjected to forging and then to T6 treatment to thereby produce an aluminum-alloy forged product.

JP-A 2002-294383 discloses a method for producing a 6000-series-alloy cast product, in which the homogenization treatment temperature is lowered or the homogenization treatment is omitted. However, this prior art does not describe high-temperature mechanical characteristics of the cast product.

In recent years, there has been increasing demand for an internal combustion engine of high efficiency and high output, and accordingly, parts employed in the engine have been further required to exhibit high-temperature mechanical strength.

An aluminum-alloy forged product produced through the aforementioned conventional method does not require provision of excess material since generation of internal defects in the forged product is suppressed. Therefore, when the forged product is employed in an internal combustion engine piston, the weight of the piston is reduced, as compared with the case where an aluminum-alloy cast product is employed. However, the forged product, in which crystallization products are formed into spherical aggregates, exhibits tensile strength at high temperatures of 300° C. or higher inferior to that of the aluminum-alloy cast product, in which crystallization product networks or acicular crystallization products formed during the course of casting remain. Therefore, in view of the fact that an aluminum-alloy forged product enables further reduction of the weight of an internal combustion engine piston, demand has arisen for a method for producing an aluminum-alloy shaped product exhibiting high-temperature mechanical strength superior to that of a conventional aluminum-alloy forged product.

In view of the foregoing, objects of the present invention are to provide a method for producing an aluminum-alloy shaped product that exhibits high-temperature mechanical strength superior to that of a conventional aluminum-alloy forged product, to provide an aluminum-alloy shaped product and to provide a production system for the shaped product.

DISCLOSURE OF THE INVENTION

In order to attain the aforementioned objects, the present invention provides a method for producing an aluminum-alloy shaped product, comprising a step of forging a continuously cast rod of aluminum alloy serving as a forging material, in which the aluminum alloy contains Si in an amount of 10.5 to 13.5 mass %, Fe in an amount of 0.15 to 0.65 mass %, Cu in an amount of 2.5 to 5.5 mass % and Mg in an amount of 0.3 to 1.5 mass %, and heat treatment and heating steps including a step of subjecting the forging material to pre-heat treatment, a step of heating the forging material during a course of forging of the forging material and a step of subjecting a shaped product to post-heat treatment, the pre-heat treatment including treatment of maintaining the forging material at a temperature of −10 to 480° C. for two to six hours.

In the method just mentioned above, the pre-heat treatment is performed at a temperature of at least 200° C. and 370° C. or lower.

In the first mentioned method, the pre-heat treatment is performed at a temperature of at least −10° C. and less than 200° C.

In the first mentioned method, the pre-heat treatment is performed at a temperature of at least 370° C. and 480° C. or lower.

In any one of the first to fourth mentioned methods, the post-heat treatment is performed at 170 to 230° C. for one to 10 hours without performing solid solution treatment.

In any one of the first to fifth mentioned methods, the aluminum alloy further contains Ni in an amount of 0.8 to 3 mass %.

In any one of the first to sixth mentioned methods, the aluminum alloy further contains P in an amount of 0.003 to 0.02 mass %.

In any one of the first to seventh mentioned methods, the aluminum alloy further contains at least one species selected from among Sr in an amount of 0.003 to 0.03 mass %, Sb in an amount of 0.1 to 0.35 mass %, Na in an amount of 0.0005 to 0.015 mass % and Ca in an amount of 0.001 to 0.02 mass %.

In any one of the first to eighth mentioned methods, wherein the aluminum alloy contains the Mg in an amount of 0.5 to 1.3 mass %.

In any one of the first to ninth mentioned methods, the aluminum alloy further contains at least one species selected from among Mn in an amount of 0.1 to 1.0 mass %, Cr in an amount of 0.05 to 0.5 mass %, Zr in an amount of 0.04 to 0.3 mass %, V in an amount of 0.01 to 0.15 mass % and Ti in an amount of 0.01 to 0.2 mass %.

In any one of the first to tenth mentioned methods, during the forging step, a percent reduction of a portion of the forging material that requires high-temperature fatigue strength resistance is regulated to 90% or less.

In any one of the first to eleventh mentioned methods, in the forging step, the heat treatment step is performed at a temperature of 380 to 480° C.

In any one of the first to twelfth mentioned methods, the continuously cast rod is produced through continuous casting of a molten aluminum alloy having an average temperature which falls within a range of a liquidus temperature +40° C. to the liquidus temperature +230° C. at a casting speed of 80 to 2,000 mm/minute.

The present invention also provides an aluminum-alloy shaped product produced through any one of the first to thirteenth mentioned methods and having a metallographic structure in which crystallization product networks, acicular crystallization products or crystallization product aggregates that have been formed during a course of continuous casting remain partially even after forging and heat treatment steps.

The present invention further provides an aluminum-alloy shaped product produced through any one of the first to thirteenth mentioned methods and having a eutectic Si area share of 8% or more, an average eutectic Si particle diameter of 5 μm or less, 25% or more of eutectic Si having an acicular eutectic Si ratio of 1.4 or more, an intermetallic compound area share of 1.2% or more, an average intermetallic compound particle diameter of 1.5 μm or more and 30% or more of intermetallic compounds or interimetallic compound aggregates having an intermetallic compound length or intermetallic compound aggregate length of 3 μm or more.

The present invention also provides a production system comprising a continuous line for performing a series of steps for producing an aluminum-alloy shaped product from a molten aluminum alloy, wherein the series of steps includes at least the steps of any one of the first to thirteenth mentioned methods.

In the production method of the present invention, the pre-heat treatment includes treatment of maintaining a forging material at −10 to 480° C. for two to six hours. Therefore, when an aluminum-alloy shaped product is produced through the production method, crystallization product networks, acicular crystallization products or crystallization product aggregates which have been formed during the course of continuous casting remain at least partially in the structure of the shaped product even after forging and post-heat treatment. Therefore, the aluminum-alloy shaped product exhibits excellent mechanical strength even at a temperature higher than 250° C. (preferably, a temperature of higher than 250° C. and 400° C. or lower).

The production method of the present invention is advantageous in that the method can produce a shaped product exhibiting, at a temperature higher than 250° C., enhanced tensile characteristics σB (MPa) and enhanced fatigue strength σw (MPa). Specifically, for example, after the thus produced shaped product is maintained at 300° C. for 100 hours, the shaped product exhibits, at 300° C., tensile strength of 65 MPa or more and fatigue strength of 40 MPa or more. Such high-temperature characteristics are required for, for example, a top surface portion of an internal combustion engine piston, which is exposed to a high-temperature atmosphere. Therefore, when an aluminum-alloy shaped product produced through the method of the present invention is employed in a top surface portion of an internal combustion engine piston, the thickness of the top surface portion can be reduced (as compared with the case of a conventional internal combustion engine piston), whereby the weight of the internal combustion engine piston can be reduced. Such weight reduction meets the requirements of the market, and enables reduction in fuel consumption by the internal combustion engine, as well as enhancement of output of the engine.

BEST MODE FOR CARRYING OUT THE INVENTION

Embodiments of the present invention will next be described in detail with reference to the annexed drawings.

Figure 1:
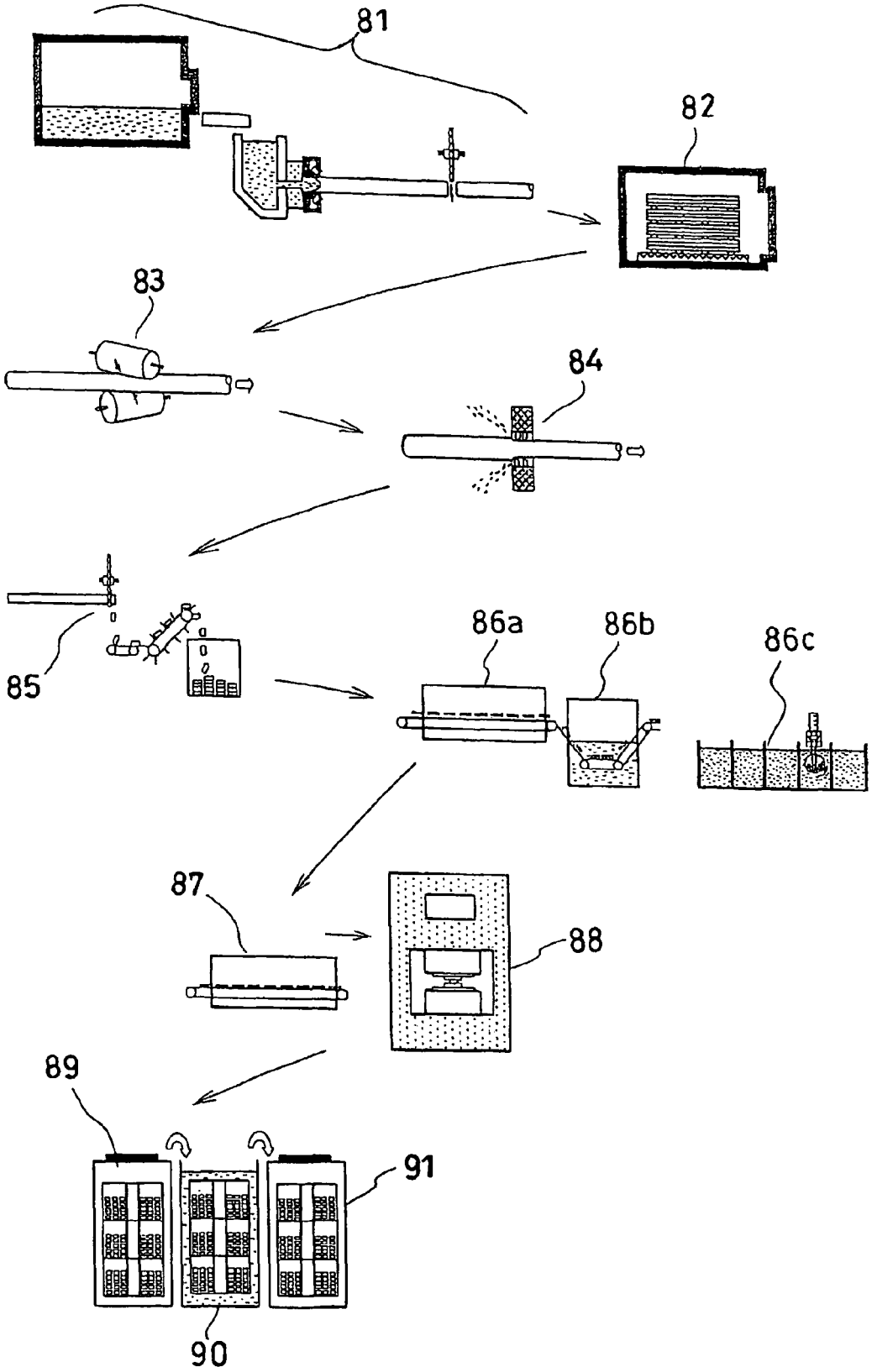
FIG. 1 shows a forging production system which is an example of a production line for carrying out the production method of the present invention.

FIG. 1 shows a forging production system which is an example of a production line for carrying out the production method of the present invention. As shown in FIG. 1, the forging production system includes a continuous casting apparatus 81 for horizontally continuously casting molten metal into a rod and for subjecting the continuously cast rod to cutting so as to attain a predetermined length; a pre-heat treatment apparatus 82 for performing heat treatment on the continuously cast rod produced in the continuous casting apparatus 81; a correction apparatus 83 for correcting bending of the continuously cast rod, which would occur during the course of heat treatment by means of the pre-heat treatment apparatus 82; a peeling apparatus 84 for removing a peripheral portion of the continuously cast rod whose bending has been corrected by means of the correction apparatus 83; a cutting apparatus 85 for cutting the continuously cast rod, the peripheral portion of which has been removed by means of the peeling apparatus 84, into pieces having a length required for producing a shaped product through forging; an upsetting apparatus (not shown) for preliminarily heating and upsetting the cut pieces obtained by means of the cutting apparatus 85; lubrication apparatuses 86*a* and 86*b* for applying a graphite lubricant to the thus upset and preliminarily heated cut pieces (forging material), for immersing the preliminarily heated forging material in a graphite lubricant, or for coating the material with a graphite lubricant; a preliminary heating apparatus 87; a forging apparatus 88 for forging the lubricant-coated forging material, which has been heated by means of the preliminary heating apparatus 87, into a product (preform); and post-heat treatment apparatuses 89, 90 and 91 for performing post-heat treatment on the forged product produced by means of the forging apparatus 88.

For example, the post-heat treatment apparatuses 89, 90 and 91 may be, respectively, a solid solution treatment apparatus 89 for subjecting the forged product to solid solution treatment, a quenching apparatus 90 for quenching the forged product which has been heated by means of the apparatus 89, and an aging treatment apparatus 91 for subjecting to aging treatment the forged product which has been quenched by means of the apparatus 90. In the case where solid solution treatment is omitted, preferably, the aging treatment apparatus 91 is provided subsequent to the forging apparatus 88, without provision of the solid solution treatment apparatus 89 and the quenching apparatus 90.

The peeling apparatus 84 and the upsetting apparatus may be omitted. Conveyance of the forging material between the respective apparatuses may be carried out by means of an automatic conveying apparatus. The lubrication apparatuses 86*a* and 86*b* for lubricant coating treatment may be replaced by an apparatus 86*c* for bonde treatment (phosphoric-acid-salt coating treatment).

The pre-heat treatment apparatus 82 has a function for maintaining the temperature of the forging material at −10° C. to 480° C. for two to six hours. The preliminary heating apparatus 87 has a function for heating the forging material to 380° C. to 480° C. Among the post-heat treatment apparatuses 89, 90 and 91, the solid solution treatment apparatus 89 and the quenching apparatus 90 have a function for increasing the temperature of the forged product (shaped product) to 480° C. to 520° C. for solid solution treatment, and then for quenching the forged product. Among the post-heat treatment apparatuses 89, 90 and 91, the aging treatment apparatus 91 has a function for maintaining the temperature of the forged product (shaped product) at 170° C. to 230° C.

The production method employing the production system of the present invention, i.e. the shaped product production method, includes a step of performing pre-heat treatment on a round rod produced through continuous casting of an aluminum alloy; a step of subjecting the thus treated round rod (i.e. forging material) to hot plastic forming, thereby forming a preform and a step of subjecting the resultant preform to post-heat treatment. In the pre-heat treatment, the temperature of the forging material is regulated to −10° C. to 480° C. During the course of hot plastic forming, the temperature of the forging material is regulated to 380° C. to 480° C. In the post-heat treatment, when solid solution treatment is performed, the temperature of the preform is regulated to 480 to 520° C., whereas when solid solution treatment is not performed and the preform is subjected directly to aging treatment, the temperature of the preform is regulated to 170° C. to 230° C. Thus, a shaped product is produced in the same production site by means of the production method including the casting step and the aforementioned heat treatment steps. Therefore, a shaped product exhibiting desired mechanical strength can be reliably produced.

The forged product which has undergone the post-heat treatment is subjected to machining by use of a lathe or a machining center to thereby form a product having the shape of a final product.

The aforementioned plastic forming may be forging. In the production method of the present invention, so long as the temperature for pre-heat treatment, the temperature of the forging material during the course of hot plastic forming and the temperature for post-heat treatment satisfy the above-described conditions, forging may be performed in combination with rolling working or extrusion working. This is because, even when forging is performed in combination with rolling working or extrusion working, crystallization product networks can be controlled in the structure of the forged product, and thus the effects of the present invention can be obtained.

Examples of the shaped product include parts requiring high-temperature mechanical strength. Specific examples include an engine piston, a valve lifter, a valve retainer and a cylinder liner.

In the production method of the present invention, basically, solidification of molten alloy may be performed by means of any known technique, such as hot top continuous casting, vertical continuous casting, horizontal continuous casting or DC casting. For example, there may be employed a horizontal continuous casting method in which one or more fluids selected from among a gas lubricant, a liquid lubricant and a gas obtained through thermal decomposition of the liquid lubricant, are fed to the inner wall of a tubular mold which has a forced cooling means and which is supported such that its center axis extends horizontally. A molten aluminum alloy containing Si is teemed into the tubular mold through a first end thereof to thereby form a columnar molten alloy main body. The main body is solidified in the tubular mold to thereby form a cast ingot. The cast ingot is removed from a second end of the tubular mold. Next will be described the case where the horizontal continuous casting method is employed in this invention.

Figure 2:
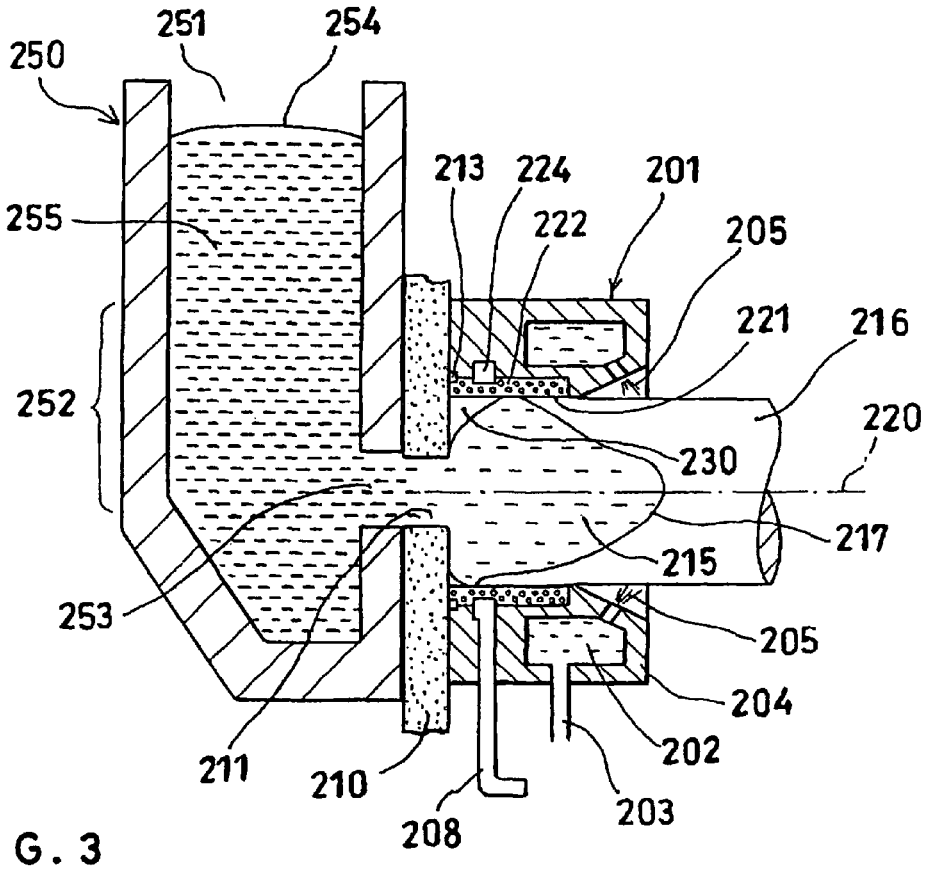
FIG. 2 shows an example of a continuous casting apparatus (in the vicinity of a mold) employed in the present invention.

FIG. 2 shows an example of a continuous casting apparatus (in the vicinity of a mold) employed in the present invention. A tundish 250, a refractory plate-like body 210, and a tubular mold 201 are provided such that a molten alloy 255 reserved in the tundish 250 is teemed through the refractory plate-like body 210 into the tubular mold 201. The tubular mold 201 is supported such that a center axis 220 extends almost horizontally. In order to solidify the molten alloy into a cast ingot 216, means for forcedly cooling the mold is provided in the interior of the tubular mold, and means for forcedly cooling the cast ingot is provided at the outlet of the tubular mold. As shown in FIG. 2, a cooling water showering apparatus. 205, which is an example of the means for forcedly cooling the cast ingot, is provided. In the vicinity of the outlet of the tubular mold, a driving apparatus (not shown) is provided so as to continuously remove the forcedly cooled cast ingot 216 from the mold at a predetermined rate. Furthermore, a synchronized cutting machine (not shown) is provided so as to cut the thus removed cast rod into pieces of predetermined length.

Figure 3:
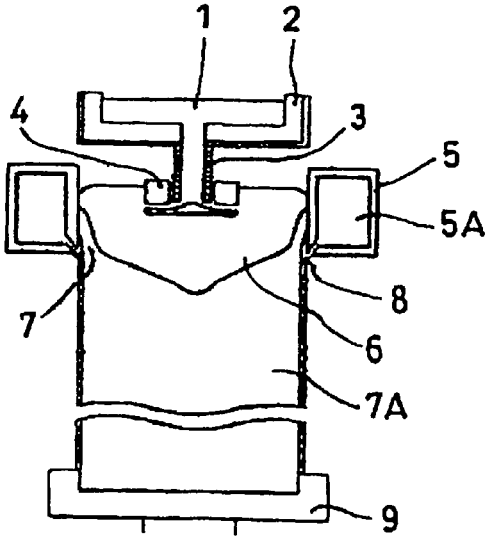
FIG. 3 shows another example of a continuous casting apparatus (in the vicinity of a mold) employed in the present invention.

Another example of a casting apparatus (in the vicinity of a mold) employed in the present invention will now be described with reference to FIG. 3. FIG. 3 is a schematic cross-sectional view showing an example of a DC casting apparatus. In this DC casting apparatus, molten aluminum alloy 1 is teemed through a trough 2, a dip tube 3 and a floating distributor 4 into a fixated water-cooling mold 5 formed of aluminum alloy or copper. The water-cooling mold 5 is cooled by cooling water 5A. Molten aluminum alloy 6 teemed into the water-cooling mold forms a solidification shell 7 at a portion at which the molten alloy comes into contact with the water-cooling mold 5, and then shrinks. The resultant aluminum-alloy cast ingot 7A is removed downward from the water-cooling mold 5 by means of a lower mold 9. Upon this removal, the aluminum-alloy cast ingot 7A is further cooled by means of a cooling water jet 8 supplied from the water-cooling mold 5 and is completely solidified. When the lower mold 9 reaches a position where it can no longer move downward, the cast ingot 7A is cut at a predetermined position and removed from the lower mold.

The continuous casting apparatus of FIG. 2 will be described again. As shown in FIG. 2, the tubular mold 201 is supported such that the center axis 220 extends almost horizontally. In addition, the tubular mold 201 includes the means for forcedly cooling the mold, the means being provided for cooling the inner wall of the mold by feeding cooling water 202 into a mold's cooling water cavity 204 to thereby remove heat from a columnar molten alloy 215 filled in the mold via the mold inner wall with which the molten alloy is in contact, thereby forming a solidification shell on the surface of the molten alloy, and the forced cooling means provided for discharging cooling water from the showering apparatus 205 so as to apply the water directly to the cast ingot at the outlet of the mold, thereby solidifying the molten alloy in the mold. The tubular mold is connected, at the end opposite to the outlet of the showering apparatus, to the tundish 250 via the refractory plate-like body 210.

As shown in FIG. 2, cooling water for forcedly cooling the mold and cooling water for forcedly cooling the cast ingot are supplied through a cooling water feed tube 203. However, these two types of cooling water may be supplied separately.

Figure 4:
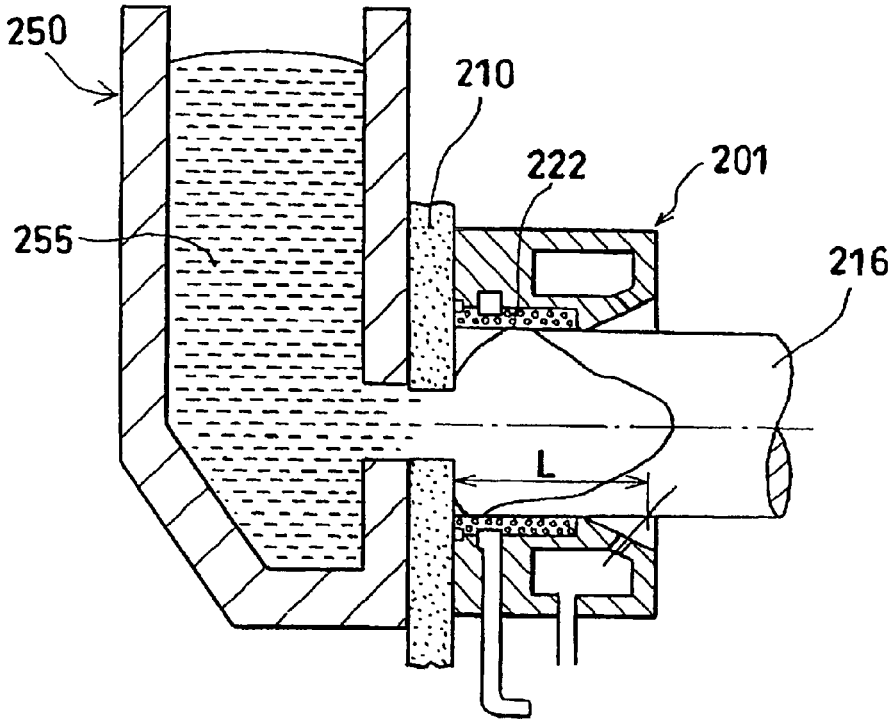
FIG. 4 shows an example of a continuous casting apparatus (in the vicinity of a mold) employed in the present invention, which illustrates an effective mold length.

An effective mold length (see reference letter L of FIG. 4) is defined as the length as measured from the point at which the center axis of the outlet of the cooling water showering apparatus intersects the surface of the cast ingot to the contact surface between the mold and the refractory plate-like body. The effective mold length is preferably 15 mm to 70 mm. When the effective mold length is less than 15 mm, a good coating fails to be formed on the molten alloy, and thus casting of the molten alloy fails to be performed. In contrast, when the effective mold length exceeds 70 mm, the effect of forced cooling is not obtained, and thus the inner wall of the mold dominates solidification of the molten alloy, whereby the contact resistance between the mold and the molten alloy or the solidification shell is increased, leading to unreliable casting (e.g., cracking occurs on the casting surface, or breakage of the cast ingot occurs in the mold).

The material of the mold is preferably at least one species selected from among aluminum, copper and alloys thereof. The combination of these species may be determined from the viewpoint of thermal conductivity, heat resistance or mechanical strength.

The mold preferably includes, on its inner wall which comes into contact with the molten alloy, a ring-shaped permeable porous member 222 exhibiting self-lubricity. The ring-shaped member is provided over the entirety of the circumferential inner wall of the tubular mold. The air permeability of the permeable porous member is preferably 0.005 to 0.03 (liter/(cm$^2$/min)), more preferably 0.07 to 0.02 (liter/(cm$^2$/min)). No particular limitations are imposed on the thickness of the permeable porous member, but the thickness is preferably 2 to 10 mm, more preferably 3 to 8 mm. The permeable porous member may be formed of, for example, graphite having air permeability of 0.008 to 0.012 (liter/(cm$^2$/min)). The "air permeability" used herein is obtained by measuring the amount of air which permeates a 5 mm-thick test piece per minute under application of a pressure of 2 (kg/cm$^2$).

In the tubular mold, preferably, the permeable porous member is provided within a range of 5 to 15 mm of the effective mold length. Preferably, an O-ring 213 is provided on the surface at which the refractory plate-like body, tubular mold and permeable porous member are in contact with one another.

The radial cross section of the inner wall of the tubular mold may assume a circular shape, triangular shape, rectangular shape or irregular shape having no symmetry axis nor symmetry plane. When a hollow cast ingot is produced, a core may be provided in the interior of the tubular mold. The tubular mold has open ends. The molten alloy is teemed through a first end of the mold (via an inlet provided in the refractory plate-like body) into the mold, and the solidified cast ingot is extruded or extracted through a second end of the mold.

The inner diameter of the mold is increased toward the cast ingot removal direction such that the elevation angle between the mold inner wall and the center axis 220 is preferably 0 to 3°, more preferably 0 to 1°. When the elevation angle is less than 0°, during removal of the cast ingot from the mold, resistance is applied to the cast ingot at the outlet of the mold, and thus casting fails to be performed. In contrast, when the elevation angle exceeds 3°, the molten alloy is incompletely brought into contact with the mold inner wall, and the mold insufficiently exerts the effect of removing heat from the molten alloy or the solidification shell, leading to insufficient solidification of the molten alloy. As a result, there is a high likelihood that casting problems occur. For example, a remelted surface is formed on the cast ingot, or unsolidified molten alloy flows out from the end of the mold.

The tundish includes a molten alloy receiving inlet 251, a molten alloy reservoir 252 and an outlet 253 through which the molten alloy is teemed into the mold. The tundish receives, through the inlet, a molten aluminum alloy whose composition is predetermined by means of, for example, a melting furnace provided outside the casting apparatus. In the tundish, the level 254 of the molten alloy is maintained at a position above the upper surface of the mold cavity. When multiple casting is performed, the molten alloy is reliably teemed from the tundish into a plurality of molds. The molten alloy reserved in the molten alloy reservoir of the tundish is teemed into the mold through a molten alloy inlet 211 provided in the refractory plate-like body.

The refractory plate-like body 210 is provided for separating the tundish from the mold. The plate-like body may be formed of a refractory, adiabatic material. Examples of the material include Lumiboard (product of Nichias Corporation), Insural (product of Foseco Ltd.) and Fiber Blanket Board (product of Ibiden Co., Ltd.). The refractory plate-like body has a shape such that a molten alloy inlet can be formed therein. One or more molten alloy inlets may be formed in a portion of the refractory plate-like body that inwardly extends from the inner wall of the tubular mold.

Reference numeral 208 denotes a fluid feed-tube for feeding a fluid. Examples of the fluid to be fed include lubrication fluids. The fluid may be one or more species selected from among a gaseous lubricant and a liquid lubricant. Preferably, a gaseous lubricant feed-tube and a liquid lubricant feed-tube are provided separately.

The fluid which is pressurized and fed through the fluid feed-tube 208 passes through a circular path 224, and is fed to a clearance between the tubular mold and the refractory plate-like body. Preferably, a clearance of 200 μm or less is formed at a portion at which the mold and the refractory plate-like body are in contact with each other. The clearance has a size such that the molten alloy does not enter the clearance and that the fluid can flow therethrough to the mold inner wall. As shown in FIG. 2, the circular path 224 is provided on the periphery of the permeable porous member 222 provided in the tubular mold. The pressurized fluid permeates throughout the permeable porous member which comes into contact with the molten alloy, and is fed to the inner wall 221 of the tubular mold. In some cases, the liquid lubricant is decomposed into a gas through heating, and the gasified lubricant is fed to the inner wall of the tubular mold.

As a result, there can be improved lubricity between the permeable porous surface of the tubular mold and the periphery of the metallic mass, i.e., the periphery of the columnar molten alloy main body or the periphery of the solidification shell. Since the ring-shaped permeable porous member is provided on the mold inner wall, an excellent lubrication effect is obtained, and a continuously cast aluminum alloy rod can be readily produced.

A corner space 230 is formed by one or more species selected from among the fed gaseous and liquid lubricants, and the gas obtained through decomposition of the liquid lubricant.

The casting step included in the production method of the present invention will now be described.

As shown in FIG. 2, the molten alloy in the tundish 250 is teemed through the refractory plate-like body 210 into the tubular mold 201 which is supported such that its center axis extends almost horizontally, and the molten alloy is forcedly cooled and solidified at the outlet of the mold to thereby form the cast ingot 216. The cast ingot 216 is continuously removed from the mold at a predetermined rate by use of the driving apparatus provided in the vicinity of the outlet of the mold to thereby form a cast rod. The resultant cast rod is cut into pieces of predetermined length by use of the synchronized cutting machine. Specifically, the continuously cast rod is produced through continuous casting of the molten aluminum alloy having an average temperature which falls within a range of the liquidus temperature +40° C. to the liquidus temperature +230° C. at a casting speed of 300 to 2,000 mm/minute. The cast rod produced through casting under the above conditions, in which crystallization products are finely dispersed, exhibits excellent forge ability and excellent high-temperature mechanical strength. In the case where hot top continuous casting, vertical continuous casting or DC casting is employed, the casting speed is preferably regulated to 80 to 400 mm/minute.

The composition of the molten aluminum alloy 255 reserved in the tundish will now be described.

The molten aluminum alloy 255 contains Si in an amount of 10.5 to 13.5 mass % (preferably 11.5 to 13.0 mass %), Fe in an amount of 0.15 to 0.65 mass % (preferably 0.3 to 0.5 mass %), Cu in an amount of 2.5 to 5.5 mass % (preferably 3.5 to 4.5 mass %) and Mg in an amount of 0.3 to 1.5 mass % (preferably 0.5 to 1.3 mass %).

When Si is contained in the molten alloy, by virtue of distribution of eutectic Si, the high-temperature mechanical strength and wear resistance of the resultant cast rod are enhanced. When Si coexists with Mg in the molten alloy, $Mg_2Si$ grains are precipitated, whereby the high-temperature mechanical strength of the cast rod is enhanced. However, when the Si content is less than 10.5%, the effects of Si are not sufficiently obtained, whereas when the Si content exceeds 12%, large amounts of primary Si crystals are formed, and the high-temperature fatigue strength, ductility and toughness of the cast rod are impaired.

When Fe is contained in the molten alloy, Al—Fe or Al—Fe—Si crystal grains are formed, whereby the high-temperature mechanical strength of the resultant cast rod is enhanced. However, when the Fe content is less than 0.15%, the effects of Fe are not. sufficiently obtained, whereas when the Fe content exceeds 0.65%, the amount of large Al—Fe or Al—Fe—Si crystallization products is increased, and the forgeability, high-temperature fatigue strength, ductility and toughness of the cast rod are impaired.

When Cu is contained in the molten alloy, $CuAl_2$ grains are precipitated, whereby the high-temperature mechanical strength of the resultant cast rod is enhanced. However, when the Cu content is less than 2.5%, the effects of Cu are not sufficiently obtained, whereas when the Cu content exceeds 5.5%, the amount of large Al—Cu crystallization products is increased, and the forgeability, high-temperature fatigue strength, ductility and toughness of the cast rod are impaired.

When Mg coexists with Si in the molten alloy, $Mg_2Si$ grains are precipitated, whereby the high-temperature mechanical strength of the resultant cast rod is enhanced. However, when the Mg content is less than 0.3%, the effects of Mg are not sufficiently obtained, whereas when the Mg content exceeds 1.5%, the amount of large $Mg_2Si$ crystallization products is increased, and the forgeability, high-temperature fatigue strength, ductility and toughness of the cast rod are impaired.

Preferably, the molten alloy 255 contains one or more species selected from among Mn (0.1 to 1.0 mass %, more preferably 0.2 to 0.5 mass %), Cr (0.05 to 0.5 mass %, more preferably 0.1 to 0.3 mass %), Zr (0.04 to 0.3 mass %, more preferably 0.1 to 0.2 mass %), V (0.01 to 0.15 mass %, more preferably 0.05 to 0.1 mass %) and Ti (0.01 to 0.2 mass %, more preferably 0.02 to 0.1 mass %). This is because, when the molten alloy contains Mn, Cr, Zr, V or Ti, an Al—Mn, Al—Fe—Mn—Si, Al—Cr, Al—Fe—Cr—Si, Al—Zr, Al—V or Al—Ti compound is crystallized or precipitated, whereby the high-temperature mechanical strength of the resultant cast aluminum alloy rod is enhanced. When the Mn content is less than 0.1%, the Cr content is less than 0.05%, the Zr content is less than 0.04%, the V content is less than 0.01% or the Ti content is less than 0.01%, the effects of such an element are not sufficiently obtained, whereas when the Mn content exceeds 1.0%, the Cr content exceeds 0.5%, the Zr content exceeds 0.3%, the V content exceeds 0.15% or the Ti content exceeds 0.2%, the amount of large crystallization products is increased, and the forgeability, high-temperature fatigue strength and toughness of the cast rod are impaired.

Preferably, the molten alloy further contains Ni in an amount of 0.8 to 3 mass % (more preferably 1.5 to 2.5 mass %). When Ni is contained in the molten alloy, Al—Ni, Al—Ni—Cu and Al—Ni—Fe crystallization products are formed, whereby the high-temperature mechanical strength of the resultant cast rod is enhanced. However, when the Ni content is less than 0.8%, the effects of Ni are not sufficiently obtained, whereas when the Ni content exceeds 3%, the amount of large crystallization products is increased, and the forgeability, high-temperature fatigue strength, ductility and toughness of the cast rod are impaired.

Preferably, the molten alloy further contains P in an amount of 0.003 to 0.02 mass % (more preferably 0.007 to 0.016 mass %). Since P enables formation of primary Si crystals, addition of P is preferable in the case where enhancement of the wear resistance of the resultant cast rod is preferential. Meanwhile, P exhibits the effect of micronizing primary Si crystals, and thus P suppresses impairment of the forgeability, ductility and high-temperature fatigue strength of the cast rod, which would occur as a result of formation of primary Si crystals. When the P content is less than 0.003%, the effect of micronizing primary Si crystals is not sufficiently obtained, and therefore large primary Si crystals are formed in the center of the cast ingot, and the forgeability, high-temperature fatigue strength, ductility and toughness of the cast rod are impaired. In contrast, when the P content exceeds 0.02%, large amounts of primary Si crystals are formed, and the forgeability, high-temperature fatigue strength, ductility and toughness of the cast rod are impaired.

Preferably, the molten alloy further contains one or more species selected from among Sr (0.003 to 0.03 mass %, more preferably 0.01 to 0.02 mass %), Sb (0.1 to 0.35 mass %, more preferably 0.15 to 0.25 mass %), Na (0.0005 to 0.015 mass %, more preferably 0.001 to 0.01 mass %) and Ca (0.001 to 0.02 mass %, more preferably 0.005 to 0.01 mass %), since such an element exhibits the effect of micronizing eutectic Si. When the Sr content is less than 0.003 mass %, the Sb content is less than 0.1 mass %, the Na content is less than 0.0005 mass % or the Ca content is less than 0.001 mass %, the micronizing effect is not sufficiently obtained, whereas when the Sr content exceeds 0.03 mass %, the Sb content exceeds 0.35 mass %, the Na content exceeds 0.015 mass % or the Ca content exceeds 0.02 mass %, the amount of large crystallization products is increased or casting defects are generated, and the forgeability, high-temperature fatigue strength and toughness of the cast rod are impaired.

The amount of Mg contained in the molten alloy is preferably 0.5 to 1.3 mass % (more preferably 0.8 to 1.2 mass %). When Mg coexists with Si in the molten alloy, $Mg_2Si$ grains are precipitated, whereby the high-temperature mechanical strength of the cast aluminum alloy rod is enhanced.

The compositional proportions of alloy components of the cast ingot can be confirmed by means of, for example, the method specified by JIS H 1305 employing an optical emission spectrometer (e.g., PDA-5500, product of Shimadzu Corporation), which is based on photoelectric photometry.

The difference in height between the level 254 of the molten alloy reserved in the tundish and the top surface of the mold inner wall is preferably 0 to 250 mm, more preferably 50 to 170 mm. This is because, when the difference in height falls within the above range, the pressure of the molten alloy teemed into the mold is well balanced with the pressures of a liquid lubricant and a gas obtained through gasification of the lubricant, and thus castability is improved, and a continuously cast aluminum alloy rod can be readily produced. When a level sensor is provided on the tundish for measuring and monitoring the level of the molten alloy, the level of the alloy can be accurately controlled to thereby maintain the aforementioned difference in height at a predetermined value.

The liquid lubricant may be a vegetable oil which functions as lubrication oil. Examples of the vegetable oil include rapeseed oil, castor oil and salad oil. Employment of such vegetable oil is preferred since it less adversely affects the environment.

The feed amount of the lubrication oil is preferably 0.05 to 5 milliliter/minute (more preferably 0.1 to 1 milliliter/minute). This is because, when the feed amount is excessively small, breakouts of the cast ingot are generated due to poor lubricity, whereas when the feed amount is excessively large, excess lubrication oil enters the cast ingot, which may impede formation of crystal grains having a uniform size.

The rate at which the cast ingot is removed from the mold (i.e., casting speed) is preferably 300 to 2,000 mm/minute (more preferably 600 to 2,000 mm/minute). This is because, when the casting speed falls within the above range, uniform, fine crystallization product networks are formed during the course of casting, and therefore the resistance to deformation of the aluminum matrix at high temperature is increased, resulting in enhancement of the high-temperature mechanical strength of the cast rod. Needless to say, the effects of the present invention are not limited by the casting speed. However, the higher the casting speed, the more remarkable the effects of the present invention.

The amount of cooling water, per mold, supplied from the cooling water showering apparatus to the mold is preferably 5 to 30 liters/minute (more preferably 25 to 30 liters/minute), for the following reasons. When the amount of cooling water is excessively small, breakouts may be generated, and the surface of the cast ingot may be re-melted to thereby form a non-uniform structure, which may impede formation of crystal grains having a uniform size. In contrast, when the amount of cooling water is excessively large, a very large amount of heat is removed from the mold, whereby casting fails to be performed. Needless to say, the effects of the present invention are not limited by the amount of cooling water. However, when the amount of cooling water is increased to thereby increase the temperature gradient from the solidification interface to the interior of the mold, the effects of the present invention become remarkable.

The average temperature of the molten alloy teemed from the tundish into the mold preferably falls within a range of the liquidus temperature +40° C. to the liquidus temperature +230° C. (more preferably a range of the liquidus temperature +60° C. to the liquidus temperature +200° C., furthermore preferably a range of the liquidus temperature +60° C. to the liquidus temperature +150° C.), for the following reasons. When the temperature of the molten alloy is excessively low, large crystallization products are formed in the mold or at a position upstream the mold, which may impede formation of crystal grains having a uniform size. In contrast, when the temperature of the molten alloy is excessively high, a large amount of hydrogen gas is taken into the molten alloy, and porosity occurs in the cast ingot, which may impede formation of crystal grains having a uniform size.

In the present invention, the above-described casting conditions are controlled such that almost no eutectic Si nor intermetallic compound is formed into spherical aggregates in the structure of the continuously cast rod, and that crystallization product networks, acicular crystallization products or crystallization product aggregates are formed in the cast rod. Therefore, the heat treatments performed subsequent to the casting sufficiently exhibit their effects.

In the present invention, a critical point is that, before the cast rod (i.e., forging material) undergoes forging, the cast rod is subjected to the pre-heat treatment. That is, the cast rod is maintained at −10 to 480° C. (preferably −10 to 400° C., more preferably −10 to 370° C.) for two to six hours. The temperature for the pre-heat treatment is furthermore preferably room temperature. Even when the pre-heat treatment is performed at room temperature or lower, the effects of the treatment can be obtained. When it is intended to acquire forging formability advantageous for forging the cast rod into a complicated shape, the temperature of the pre-heat treatment is preferably in the range of 370 to 480° C.

When the pre-heat treatment is performed as described above, crystallization product networks, acicular crystallization products or crystallization product aggregates, which have been formed in the structure of the cast rod during the course of continuous casting, remain partially in an aluminum shaped product even after forging and post-heat treatment. Since such crystallization products exhibit resistance to deformation of the aluminum matrix at high temperature, the aluminum shaped product exhibits excellent mechanical strength even at a high temperature of higher than 250° C. and 400° C. or lower. That is, since the crystallization product networks, the acicular crystallization products or the crystallization product aggregates exhibit resistance to deformation of the aluminum matrix at a high temperature at which the matrix is softened, the aluminum shaped product exhibits excellent high-temperature mechanical strength. Meanwhile, when the temperature for the pre-heat treatment is high and the percent reduction of the forging material is high, the crystallization product networks, the acicular crystallization products or the crystallization product aggregates are fragmented, agglomerated in the form of granules and uniformly dispersed in the aluminum matrix which has been softened at high temperature. Therefore, the crystallization products exhibit lowered resistance to deformation of the aluminum matrix at high temperature, and the high-temperature mechanical strength of the aluminum shaped product fails to be enhanced.

In the present invention, by virtue of the above-described alloy composition, crystallization product networks, acicular crystallization products or crystallization product aggregates, which exhibit resistance to deformation of the aluminum matrix at a high temperature of higher than 250° C. and 400° C. or lower, at which the aluminum matrix is softened and is apt to be deformed considerably, remain partially in the aluminum shaped product. Therefore, the aluminum shaped product exhibits enhanced high-temperature mechanical strength.

In the case of production of a low-Si-content alloy (e.g., a 6000 series alloy) in which crystallization product networks or acicular crystallization products are less contained, i.e. the amount of crystallization products is relatively small, the homogenization treatment temperature is lowered or the homogenization treatment is omitted for the purpose of suppressing recrystallization or simplifying the production process. Unlike the above case, in the present invention, the homogenization treatment temperature is lowered or the homogenization treatment is omitted for the purpose of maintaining, at a maximum possible level, the amount of crystallization product networks or acicular crystallization products, which are formed during the course of casting and remain in large amounts in the high-Si-content alloy forging material, thereby improving high-temperature characteristics of the forging material.

As described in the section "Background Art," JP-A 2002-294383 discloses a technique relating to a 6000 series alloy, in which the homogenization treatment temperature is lowered or the homogenization treatment is omitted in order not to improve high-temperature characteristics of the alloy, but to suppress recrystallization for improving ambient-temperature mechanical characteristics of the alloy. The 6000 series alloy of low Si content, which differs from the alloy employed in the present invention, contains a relatively small amount of crystallization products, i.e. a small amount of crystallization product networks or acicular crystallization products. In this conventional case, the homogenization treatment temperature is lowered for the purpose of finely precipitating an Al—Mn or Al—Cr compound which suppresses recrystallization. Unlike the above case, in the present invention, the homogenization treatment temperature is lowered or the homogenization treatment is omitted for the purpose of maintaining, at a maximum possible level, the amount of crystallization product networks or acicular crystallization products, which are formed during the course of casting and remain in large amounts in the high-Si-content alloy forging material, thereby improving high-temperature characteristics of the forging material.

Particularly, in order to enhance the high-temperature mechanical strength of the forging material and to improve forgeability thereof, preferably, the forging material is subjected to pre-heat treatment at a temperature of 200° C. to 370° C. When the pre-heat treatment is performed within the above temperature range, eutectic Si or an intermetallic compound tends not to be formed into spherical aggregates during the pre-heat treatment, and thus crystallization product networks, acicular crystallization products or crystallization product aggregates, which have been formed during the course of continuous casting, remain partially in the aluminum shaped product even after forging and post-heat treatment. Therefore, the aluminum shaped product exhibits excellent high-temperature mechanical strength.

Particularly, in order to further enhance the high-temperature mechanical strength of the forging material, preferably, the forging material is subjected to pre-heat treatment at a temperature of −10° C. to 200° C. When the pre-heat treatment is performed within the above temperature range, almost no eutectic Si nor intermetallic compound is formed into spherical aggregates during the pre-heat treatment, and thus crystallization product networks, acicular crystallization products or crystallization product aggregates, which have been formed during the course of continuous casting, remain partially in the aluminum shaped product even after forging and post-heat treatment. Therefore, the aluminum shaped product exhibits excellent high-temperature mechanical strength.

The pre-heat treatment can be performed between the casting step and the forging step. For example, the pre-heat treatment is performed within one day after the casting step, and the forging step is performed within one week after the pre-heat treatment. Before the forging step is performed, the forging material can be subjected to correction treatment and peeling treatment.

Next will be described an example of the forging step included in the production method of the present invention.

The forging step includes 1) a step of cutting the continuously cast round rod into pieces of predetermined length, 2) a step of preliminarily heating and upsetting the thus cut forging material, 3) a step of lubricating the thus upset forging material, 4) a step of placing the forging material into a die set and subjecting the material to forging and 5) a step of discharging a forged product from the die set by means of a knock-out mechanism.

A lubricant may be applied to the forging material, and the forging material may be heated before being subjected to upsetting treatment. The upsetting step may be omitted.

The lubrication treatment may be application of a water-soluble lubricant to the forging material or bonde treatment of the forging material. For example, preferably, the forging material is subjected to bonde treatment and then preliminarily heated to 380 to 480° C., followed by placing of the material into a forging apparatus. When the forging material is preliminarily heated to 380 to 480° C., deformability of the forging material is enhanced, and the material is readily forged into a product of complicated shape.

The lubricant to be employed is preferably an aqueous lubricant, more preferably a water-soluble graphite lubricant, since graphite sufficiently sticks to the forging material. The lubrication step is preferably performed through, for example, the following procedure. A lubricant is applied to the forging material at a temperature of 70 to 350° C., the forging material is cooled to room temperature and the temperature of the material is maintained at room temperature for a predetermined period of time (e.g., two to four hours), and the forging material is heated to 380 to 480° C., followed by placing of the material into a forging apparatus. The lubricant to be employed is preferably an aqueous lubricant, more preferably a water-soluble graphite lubricant, since graphite sufficiently sticks to the forging material.

Before the forging material is placed into a die set, a lubricant is applied to the surface of the die set. Through regulation of the time for spraying the lubricant to the die set, the amount of the lubricant can be more appropriately determined so as to be adapted to a combination of an upper die and die blocks. The lubricant to be employed is preferably an oil lubricant (e.g., a mineral oil) for the following reason. When an oil lubricant is employed, lowering of the die set temperature, which may occur when an aqueous lubricant is employed, can be suppressed. The lubricant to be employed is more preferably a mixture of graphite and a mineral oil from the viewpoint of enhancement of lubrication effects.

The die set is preferably heated to a temperature of 150 to 250° C. This is because, when the die set temperature falls within the above range, sufficient plastic flow can be attained.

In the present invention, during the forging step, the percent reduction of a portion of the forging material that requires resistance to high-temperature fatigue strength is preferably regulated to 90% or less (more preferably 70% or less). When the percent reduction falls within the above range, crystallization product networks, acicular crystallization products or crystallization product aggregates are prevented from being fragmented, and thus the resultant shaped product exhibits excellent high-temperature mechanical strength.

No particular limitations are imposed on the shaped product so long as a portion thereof that requires high-temperature mechanical strength satisfies the above percent reduction.

In the case where a plastic forming step (e.g., an upsetting step) is performed before the forging step, preferably, percent reduction per plastic forming step is determined in consideration of the number of the steps. For example, when a shaped product having a complicated shape is to be produced, preferably, a plastic forming step (percent reduction per step: 10 to 80%, more preferably 10 to 50%) is performed a plurality of times (preferably twice). For example, the percent reduction at the first plastic forming step is preferably regulated to 10 to 50% (more preferably 10 to 30%).

The term "percent reduction" used herein is defined as follows.

Percent reduction (%)=(thickness before plastic forming−thickness after plastic forming)/(thickness before plastic forming)×100

The resultant forged product is subjected to post-heat treatment. The post-treatment may be a combination of solid solution treatment and aging treatment. The post-heat treatment can be performed within one week after the forging step.

The solid solution treatment can be performed at 480 to 520° C. (preferably 490 to 510° C.) for three hours.

In the present invention, preferably, the above-forged product is subjected to aging treatment at 170 to 230° C. (preferably 190 to 210° C.) for one to 10 hours without being subjected to solid solution treatment and quenching treatment. This is because, when the forged product is subjected to aging treatment under the above conditions, crystallization product networks, acicular crystallization products or crystallization product aggregates can be prevented from being fragmented and agglomerated, and the resultant shaped product exhibits excellent high-temperature mechanical strength.

In the alloy structure of the thus produced aluminum shaped product, eutectic Si or an intermetallic compound tends not to be formed into spherical aggregates. Thus, crystallization product networks, acicular crystallization products, or crystallization product aggregates, which have been formed during the course of continuous casting, remain partially in the shaped product even after forging and post-heat treatment. Therefore, the aluminum shaped product exhibits excellent high-temperature mechanical strength.

The aluminum alloy constituting the shaped product contains Si in an amount of 10.5 to 13.5 mass % (preferably 11.0 to 13.0 mass %), Fe in an amount of 0.15 to 0.65 mass % (preferably 0.3 to 0.5 mass %), Cu in an amount of 2.5 to 5.5 mass % (preferably 3.5 to 4.5 mass %) and Mg in an amount of 0.3 to 1.5 mass % (preferably 0.5 to 1.3 mass %).

Preferably, the aluminum alloy further contains one or more species selected from among Mn (0.1 to 1.0 mass %, more preferably 0.2 to 0.5 mass %), Cr (0.05 to 0.5 mass %, more preferably 0.1 to 0.3 mass %), Zr (0.04 to 0.3 mass %, more preferably 0.1 to 0.2 mass %), V (0.01 to 0.15 mass %, more preferably 0.05 to 0.1 mass %) and Ti (0.01 to 0.15 mass %, more preferably 0.05 to 0.1 mass %).

Preferably, the aluminum alloy further contains Ni in an amount of 0.8 to 3 mass % (more preferably 1.6 to 2.4 mass %).

Preferably, the aluminum alloy further contains P in an amount of 0.003 to 0.02 mass % (more preferably 0.007 to 0.016 mass %).

Preferably, the aluminum alloy further contains one or more species selected from among Sr (0.003 to 0.03 mass %, more preferably 0.01 to 0.02 mass %), Sb (0.1 to 0.35 mass %, more preferably 0.15 to 0.25 mass %) and Na (0.001 to 0.02 mass %, more preferably 0.005 to 0.015 mass %).

The amount of Mg contained in the aluminum alloy is preferably 0.5 to 1.3 mass % (more preferably 0.8 to 1.2 mass %).

In the alloy structure of the aluminum shaped product thus produced, eutectic Si or an intermetallic compound tends not to be formed into spherical aggregates. Thus, the crystallization product networks, acicular crystallization products or crystallization product aggregates, which have been formed in the structure of the cast rod during the course of continuous casting, remain partially in an aluminum shaped product even after forging and post-heat treatment. As a result, the aluminum-alloy shaped product has a eutectic Si area share of 8% or more (preferably 8 to 18%, more preferably 9 to 14%), an average eutectic Si particle diameter of 5 μm or less (preferably 1 to 5 μm, more preferably 1.5 to 4 μm), 25% or more (preferably 25 to 85%, more preferably 30 to 75%) of eutectic Si having an acicular eutectic Si ratio of 1.4 or more (preferably 1.4 to 3, more preferably 1.6 to 2.5), an intermetallic compound area share of 1.2% or more (preferably 1.2 to 7.5%, more preferably 1.5 to 6%), an average intermetallic compound particle diameter of 1.5 μm or more (preferably 1.5 to 5 μm, more preferably 1.8 to 4 μm) and 30% or more (preferably 30 to 75%, more preferably 35 to 65%) of intermetallic compounds or intermetallic compound aggregates having an intermetallic compound length or intermetallic compound aggregate length of 3 μm or more (preferably 3 to 30 μm, more preferably 4 to 20 μm). Therefore, the aluminum-alloy shaped product exhibits excellent high-temperature mechanical strength.

Figure 5:
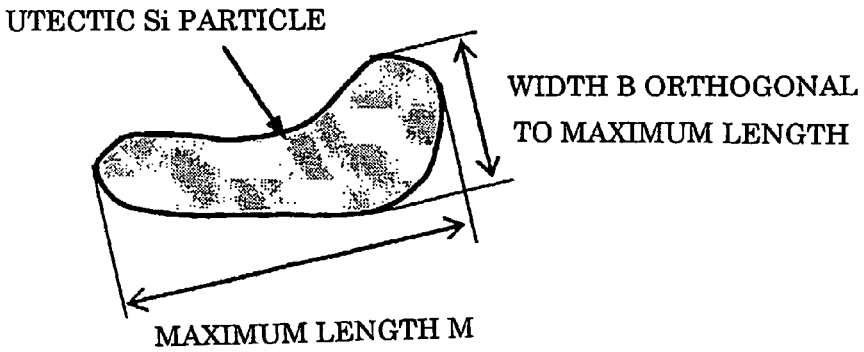
FIG. 5 is an explanatory view showing an acicular eutectic Si ratio.
Figure 6:
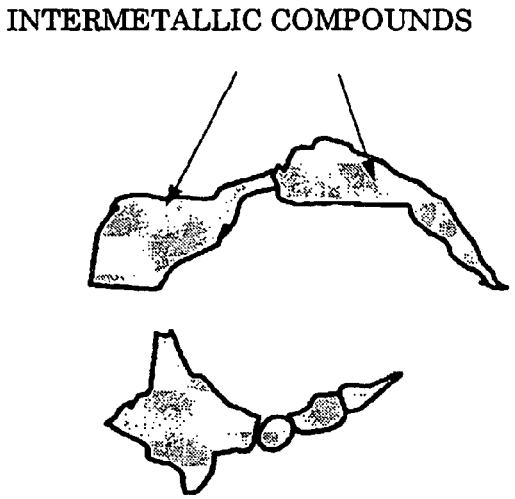
FIG. 6 is an explanatory view showing aggregates of intermetallic compounds.

The crystallization products of the aluminum-alloy shaped product comprise eutectic Si, an intermetallic compound and their aggregates in the form of crystallization product networks, acicular crystallization products or crystallization product aggregates. An acicular eutectic Si ratio is, as shown in FIG. 5, is defined by M/B in which M stands for the maximum length of the eutectic Si and B for the width of the eutectic Si orthogonal to the direction of the maximum length M. As shown in FIG. 6, the intermetallic compound aggregates mean two or more intermetallic compounds in a connected state.

EXAMPLES

The present invention will next be described in detail by way of Examples, which should not be construed as limiting the invention thereto.

An aluminum-alloy shaped product was produced by use of the production system shown in FIG. 1.

Figure 7:
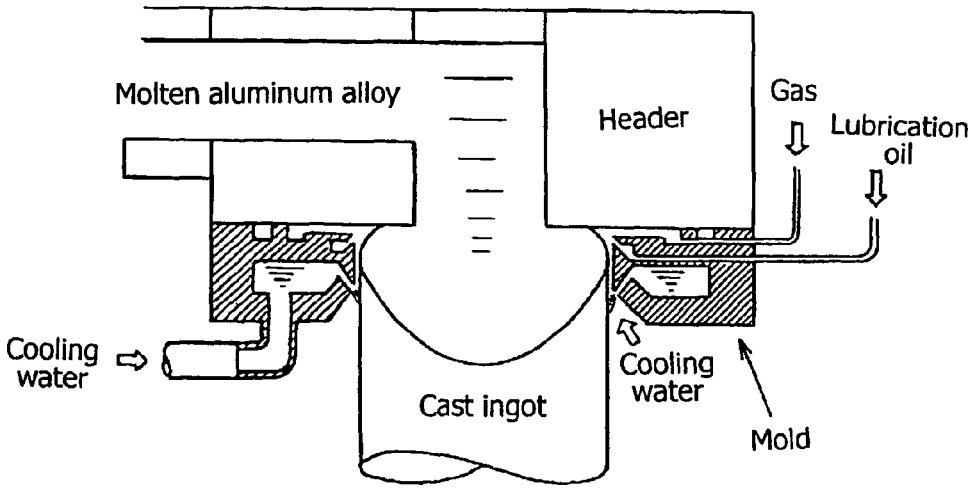
FIG. 7 shows another example of a continuous casting apparatus employed in the present invention.

Production Conditions:

A round rod (ϕ: 85 mm) was cast by use of a hot top continuous casting apparatus shown in FIG. 7. The thus cast round rod was cut into pieces (forging material) having a thickness of 20 mm or 80 mm. The forging material was preliminarily heated to 420° C., and then subjected to upsetting so as to attain a thickness of 10 mm. During the course of upsetting, the percent reduction was regulated to 50% for a round rod piece having a thickness of 20 mm and 87.5% for a round rod piece having a thickness of 80 mm.

Tables 1-I and 1-II show the composition of alloys employed in Examples and Comparative Examples, heat treatment conditions employed therein, percent reduction during the course of upsetting, etc. Table 2 shows the results of evaluation of the thus upset products.

TABLE 1-I

| | Pre-heat treatment (homogenization treatment) (° C.) | | | | | | Percent Reduction During upsetting | Post-heat treatment | | |
|---|---|---|---|---|---|---|---|---|---|---|
| | 490 | 470 | 440 | 400 | 370 | 200 or lower | | Solid Solution | Quenching | Aging |
| Comp. Ex. 1 | ○ | — | — | — | — | — | 50% | ○ | ○ | ○ |
| Comp. Ex. 1-1 | ○ | — | — | — | — | — | 87.5% | ○ | ○ | ○ |
| Ex. 1 | — | — | — | — | — | Room temp. | 50% | ○ | ○ | ○ |
| Ex. 2 | — | — | — | — | ○ | — | 50% | ○ | ○ | ○ |
| Ex. 2-1 | — | — | — | — | ○ | — | 87.5% | ○ | ○ | ○ |
| Ex. 2-2 | — | — | — | — | — | 200 | 50% | ○ | ○ | ○ |
| Ex. 2-3 | — | — | — | — | — | 100 | 50% | ○ | ○ | ○ |
| Ex. 2-4 | — | ○ | ○ | ○ | — | — | 50% | ○ | ○ | ○ |
| Ex. 3 | — | — | — | — | — | Room temp. | 50% | — | — | ○ |
| Ex. 4 | — | — | — | — | ○ | — | 50% | — | — | ○ |
| Ex. 5 | — | — | — | — | ○ | — | 50% | ○ | ○ | ○ |
| Ex. 6 | — | — | — | — | ○ | — | 87.5% | ○ | ○ | ○ |
| Ex. 7 | — | — | — | — | ○ | — | 50% | ○ | ○ | ○ |
| Ex. 8 | — | — | — | — | ○ | — | 87.5% | ○ | ○ | ○ |
| Ex. 9 | — | — | — | — | ○ | — | 50% | ○ | ○ | ○ |
| Ex. 10 | — | — | — | — | ○ | — | 50% | ○ | ○ | ○ |
| Ex. 11 | — | — | — | — | ○ | — | 50% | ○ | ○ | ○ |
| Ex. 12 | — | — | — | — | ○ | — | 50% | ○ | ○ | ○ |
| Ex. 13 | — | — | — | — | ○ | — | 50% | ○ | ○ | ○ |
| Ex. 14 | — | — | — | — | ○ | — | 50% | ○ | ○ | ○ |
| Ex. 15 | — | — | — | — | — | Room Temp. | 50% | ○ | ○ | ○ |
| Ex. 16 | — | ○ | — | — | — | — | 50% | ○ | ○ | ○ |
| Ex. 17 | — | — | ○ | — | — | — | 50% | ○ | ○ | ○ |
| Ex. 18 | — | — | — | ○ | — | — | 50% | ○ | ○ | ○ |
| Ex. 19 | — | — | — | — | ○ | — | 50% | ○ | ○ | ○ |
| Ex. 20 | — | ○ | — | — | — | — | 50% | ○ | ○ | ○ |
| Ex. 21 | — | — | ○ | — | — | — | 50% | ○ | ○ | ○ |
| Ex. 22 | — | — | ○ | — | — | — | 87.5% | ○ | ○ | ○ |
| Ex. 23 | — | — | — | ○ | — | — | 50% | ○ | ○ | ○ |

TABLE 1-II

| | Compositional proportions (mass %) | | | | | | | | | | | |
|---|---|---|---|---|---|---|---|---|---|---|---|---|
| | Si | Fe | Cu | Mn | Mg | Ni | V | Zr | Ti | P | Sb | Sr |
| Comp. Ex. 1 | 11.7 | 0.17 | 4.0 | 0.23 | 0.42 | | | | | | | |
| Comp. Ex. 1-1 | do. | do. | do. | do. | do. | | | | | | | |
| Ex. 1 | do. | do. | 3.9 | do. | do. | | | | | | | |
| Ex. 2 | do. | do. | do. | do. | do. | | | | | | | |
| Ex. 2-1 | do. | do. | do. | do. | do. | | | | | | | |

TABLE 1-II-continued

| | Compositional proportions (mass %) | | | | | | | | | | | |
|---|---|---|---|---|---|---|---|---|---|---|---|---|
| | Si | Fe | Cu | Mn | Mg | Ni | V | Zr | Ti | P | Sb | Sr |
| Ex. 2-2 | do. | do. | do. | do. | do. | | | | | | | |
| Ex. 2-3 | do. | do. | do. | do. | do. | | | | | | | |
| Ex. 2-4 | do. | do. | do. | do. | do. | | | | | | | |
| Ex. 3 | do. | do. | do. | do. | do. | | | | | | | |
| Ex. 4 | do. | do. | do. | do. | do. | | | | | | | |
| Ex. 5 | 11.9 | 0.23 | 3.3 | | 0.87 | 2.4 | 0.1 | 0.12 | | 0.006 | | |
| Ex. 6 | do. | do. | do. | | do. | do. | do. | do. | | do. | | |
| Ex. 7 | 12.8 | 0.49 | 3.8 | 0.23 | 1.09 | 2.0 | | | 0.1 | 0.009 | | |
| Ex. 8 | do. | do. | do. | do. | do. | do. | | | do. | do. | | |
| Ex. 9 | 13.4 | 0.61 | 4.1 | 0.32 | 1.21 | 2.2 | | | | 0.01 | | |
| Ex. 10 | 11.0 | 0.25 | 3.0 | 0.10 | 0.40 | 1.8 | | | | do. | | |
| Ex. 11 | do. | do. | do. | do. | do. | do. | | | | | | 0.015 |
| Ex. 12 | 11.8 | 0.33 | 3.3 | | 0.72 | 2.2 | | | | 0.005 | | |
| Ex. 13 | do. | do. | do. | | do. | do. | | | | | 0.2 | |
| Ex. 14 | 13.4 | 0.61 | 4.1 | 0.32 | 1.21 | do. | | | | None. | | |
| Ex. 15 | 11.5 | 0.19 | 5.1 | 0.21 | 1.14 | 0.9 | | | | 0.007 | | |
| Ex. 16 | 12.3 | 0.3 | 3.3 | 0.15 | 0.85 | 1.8 | | | 0.05 | 0.005 | | |
| Ex. 17 | do. | do. | do. | do. | do. | do. | | | do. | do. | | |
| Ex. 18 | do. | do. | do. | do. | do. | do. | | | do. | do. | | |
| Ex. 19 | do. | do. | do. | do. | do. | do. | | | do. | do. | | |
| Ex. 20 | 12.8 | 0.45 | 3.8 | 0.25 | 0.9 | 2.1 | | | | 0.01 | | |
| Ex. 21 | do. | do. | do. | do. | do. | do. | | | | do. | | |
| Ex. 22 | do. | do. | do. | do. | do. | do. | | | | do. | | |
| Ex. 23 | do. | do. | do. | do. | do. | do. | | | | do. | | |

TABLE 2

| | Metallographic structure | 300° C. tensile characteristics σB (MPa) | σ0.2 (MPa) | δ (%) | 300° C. fatigue strength ($10^7$) σw (MPa) |
|---|---|---|---|---|---|
| Comp. Ex. 1 | Δx | 62 | 42 | 37.9 | 35 |
| Comp. Ex. 1-1 | Δx | 60 | 40 | 38.8 | 34 |
| Ex. 1 | ○ | 74 | 50 | 26.1 | 46 |
| Ex. 2 | ○ | 68 | 46 | 35.3 | 45 |
| Ex. 2-1 | ○Δ | 66 | 44 | 37.0 | 43 |
| Ex. 2-2 | ○ | 70 | 48 | 30.4 | 45 |
| Ex. 2-3 | ○ | 72 | 49 | 28.2 | 46 |
| Ex. 2-4 | ○ | 66 | 43 | 36.8 | 43 |
| Ex. 3 | ○ | 79 | 44 | 15.4 | 52 |
| Ex. 4 | ○ | 75 | 43 | 19.0 | 51 |
| Ex. 5 | ○ | 80 | 51 | 19.1 | 56 |
| Ex. 6 | ○Δ | 77 | 47 | 20.0 | 54 |
| Ex. 7 | ○ | 82 | 53 | 17.5 | 58 |
| Ex. 8 | ○Δ | 79 | 50 | 18.9 | 56 |
| Ex. 9 | ○ | 85 | 56 | 16.8 | 60 |
| Ex. 10 | ○ | 77 | 48 | 18.2 | 51 |
| Ex. 11 | ○ | 79 | 48 | 18.6 | 55 |
| Ex. 12 | ○ | 81 | 50 | 17.6 | 57 |
| Ex. 13 | ○ | 80 | 50 | 18 | 60 |
| Ex. 14 | ○ | 84 | 55 | 16.0 | 59 |

TABLE 2-continued

| | Metallographic structure | 300° C. tensile characteristics σB (MPa) | σ0.2 (MPa) | δ (%) | 300° C. fatigue strength ($10^7$) σw (MPa) |
|---|---|---|---|---|---|
| Ex. 15 | ○ | 80 | 52 | 17.4 | 50 |
| Ex. 16 | ○Δ | 72 | 42 | 23.4 | 48 |
| Ex. 17 | ○ | 74 | 45 | 21.8 | 50 |
| Ex. 18 | ○ | 76 | 47 | 19.2 | 52 |
| Ex. 19 | ○ | 77 | 49 | 18.4 | 53 |
| Ex. 20 | ○Δ | 75 | 45 | 22.0 | 49 |
| Ex. 21 | ○ | 78 | 50 | 19.5 | 54 |
| Ex. 22 | ○Δ | 76 | 47 | 20.6 | 51 |
| Ex. 23 | ○ | 80 | 52 | 17.9 | 50 |

Figure 8:
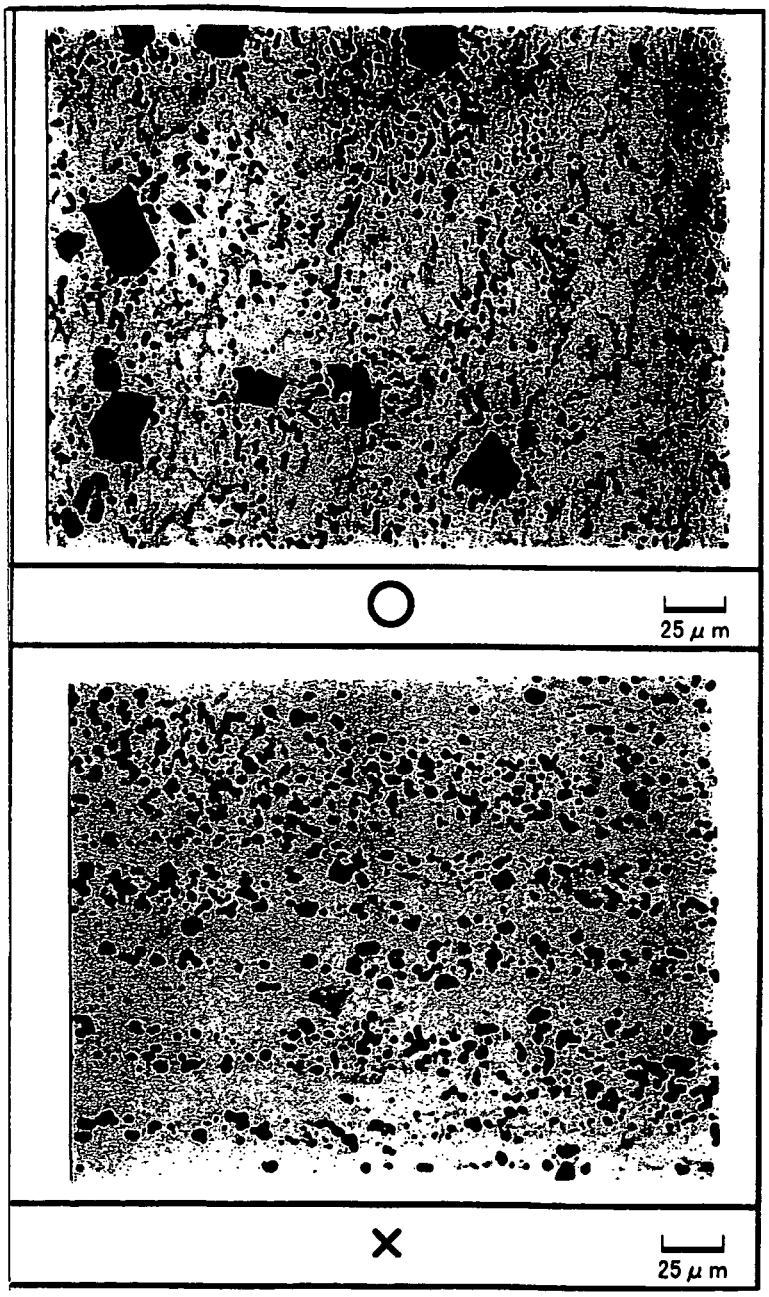
FIG. 8 shows micrographs employed for evaluation of crystallization product networks in the upset products of Examples.
Figure 9:
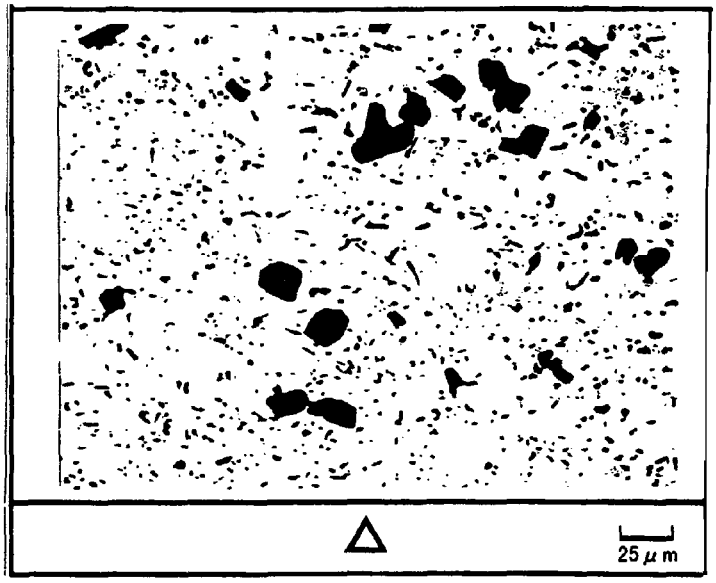
FIG. 9 shows a micrograph employed for evaluation of crystallization product networks in the upset products of Examples.

Evaluation Methods:

A sample for metallographic structural observation was cut out of each of the upset products at a center portion of a vertical cross section thereof, and the sample was subjected to micro polishing. Thereafter, crystallization product networks were evaluated by use of a micrograph of the thus polished sample. FIGS. 8 and 9 show micrographs employed for evaluation of the networks. When the sample has a metallographic structure as shown in the upper micrograph of FIG. 8, crystallization product networks are regarded as remaining in the sample, and rating "○" is assigned thereto. When the sample has a metallographic structure as shown in the lower micrograph of FIG. 8, crystallization product networks are regarded as not remaining in the sample, and rating "×" is assigned thereto. When the sample has a metallographic structure as shown in the micrograph of FIG. 9, crystallization product networks are regarded as being partially fragmented, and rating "Δ" is assigned thereto. On the basis of these evaluation criteria, the metallographic structures of the upset products of Examples and Comparative Examples were evaluated. The results are shown in Table 2. In Table 2, rating "○Δ" refers to a rating between ○ and Δ, whereas rating "Δ×" refers to a rating between Δ and ×.

A test piece was cut out of each of the upset products through machining, and the test piece was subjected to tensile test by use of Autograph (product of Shimadzu Corporation) under the conditions such that the temperature of the test piece became 300° C.

A test piece was cut out of each of the upset products through machining, and the test piece was subjected to fatigue strength test by use of an Ono-type rotating-bending fatigue test machine under the conditions such that the temperature of the test piece became 300° C. Cyclic stress was applied to the test piece 10,000,000 times, and the maximum stress at which breakage of the test piece does not occur was determined.

The tensile test and fatigue strength test were performed after the test piece was preliminarily heated to 300° C. for 100 hours.

Tables 1-I, 1-II and 2 indicate the following. Comparison among Comparative Examples 1 and 1-1 and Examples 1, 2, 2-1, 2-2, 2-3 and 2-4 reveals that the temperature for pre-heat treatment is preferably less than 490° C.

Comparison among Examples 1, 2, 2-1, 2-2, 2-3 and 2-4 reveals that the temperature for pre-heat treatment is more preferably a temperature in the vicinity of room temperature.

Comparison between Examples 1 and 3 and comparison between Examples 2 and 4 reveal that the upset products of Examples 3 and 4, in which solid solution treatment and quenching treatment were not performed, exhibit characteristics superior to those of the upset products of Examples 1 and 2.

Comparison among Examples 1, 5, 7 and 9 reveals that the upset products of Examples 5, 7 and 9, each of which contains Ni and an increased amount of Mg, exhibit characteristics superior to those of the upset product of Example 1.

Comparison among Examples 1, 10 and 11 reveals that the upset products of Examples 10 and 11, each of which contains Ni, exhibit characteristics superior to those of the upset product of Example 1.

Comparison between Examples 9 and 14 reveals that the upset product of Example 9, which contains P, exhibits characteristics superior to those of the upset product of Example 14.

Comparison between Examples 1 and 15 reveals that the upset product of Example 15, which contains Ni and increased amounts of Cu and Mg, exhibits characteristics superior to those of the upset product of Example 1.

Comparison among Examples 16, 17, 18 and 19 reveals that the better, the lower the homogenization treatment temperature is. Comparison among Examples 20, 21 and 22 reveals that the better, the lower the homogenization treatment is.

As a result of the metallographic structural observation, the aluminum-alloy shaped product in each of Examples 1 to 23 had a eutectic Si area share of 8% or more, an average eutectic Si particle diameter of 5 μm or less, 25% or more of eutectic Si having an acicular eutectic Si ratio of 1.4 or more, an intermetallic compound area share of 1.2% or more, an average intermetallic compound particle diameter of 1.5 μm or more and 30% or more of intermetallic compounds or intermetallic compound aggregates having an intermetallic compound length or intermetallic compound aggregate length of 3 μm or more.

Data on the eutectic Si particles and intermetallic compounds observed are shown in Tables 3-I and 3-II below.

TABLE 3-I

| | Observation results of alloy structure after heat treatment for forging | | | | | | |
|---|---|---|---|---|---|---|---|
| | Eutectic Si | | Acicular eutectic Si ratio and generation ratio thereof | | | | |
| | Area share (%) | Average particle diameter (μm) | <1.4 | 1.4≤ & ≤1.5 | 1.6≤ & ≤2.5 | >2.5 & ≤3 | >3 |
| Ex. 1 | 9.7 | 2.2 | 73 (%) | 10 (%) | 15 (%) | 2 (%) | 0 (%) |
| Ex. 7 | 9.3 | 3.0 | 34 | 20 | 41 | 5 | 0 |
| Ex. 20 | 9.7 | 3.1 | 55 | 18 | 23 | 4 | 0 |
| Comp. Ex. 1 | 9.6 | 2.1 | 79 | 10 | 11 | 0 | 0 |

TABLE 3-II

| | Observation results of alloy structure after heat treatment for forging | | | | | | |
|---|---|---|---|---|---|---|---|
| | Intermetallic compound | | Length (μm) & generation ratio (%) of intermetallic compound aggregate | | | | |
| | Area share (%) | Average particle diameter (μm) | <3 (μm) | 3≤ & <4 (μm) | 4≤ & ≤20 (μm) | >20 & ≤30 (μm) | >30 (μm) |
| Ex. 1 | 1.3 | 1.8 | 69 (%) | 15 (%) | 16 (%) | 0 (%) | 0 (%) |
| Ex. 7 | 4.2 | 2.8 | 49 | 20 | 26 | 5 | 0 |
| Ex. 20 | 4.3 | 2.7 | 60 | 18 | 20 | 2 | 0 |
| Comp. Ex. 1 | 1 | 1.4 | 80 | 10 | 10 | 0 | 0 |

Industrial Applicability

The present invention relates to an aluminum-alloy shaped product exhibiting excellent high-temperature tensile strength and excellent high-temperature fatigue strength, which is suitable for use in an internal combustion engine piston and to a method for producing the shaped product.

The invention claimed is:

1. A method for producing an aluminum-alloy shaped product, comprising the following steps in the order indicated:

(a) continuously casting molten aluminum alloy into a forging material in the form of a rod, wherein the molten aluminum alloy contains Si in an amount of 10.5 to 13.5 mass %, Fe in an amount of 0.15 to 0.65 mass %, Cu in an amount of 2.5 to 5.5 mass %, Mg in an amount of 0.3 to 1.5 mass %, Ni in an amount of 2.4 to 3 mass %, Pin an amount of 0.003 to 0.02 mass %, Zr in an amount of 0.04 to 0.3 mass %, V in an amount of 0.01 to 0.15 mass %, Cr in an amount suppressed to not more than 0.5 mass %, Na in an amount suppressed to not more than 0.015 mass %, Ca in an amount suppressed to not more than 0.02 mass % and the balance comprising aluminum and an inevitable impurity;

(b) subjecting the forging material to a pre-heat treatment by maintaining the forging material at a temperature of at least 370° C. and 480° C. or lower for two to six hours;

(c) upsetting the forging material in an upsetting apparatus;

(d) forging the forging material into a forged product, wherein during the forging, a percent reduction of a portion of the forging material that requires high-temperature fatigue strength resistance is regulated to 90% or less;

(e) subjecting the forged product to a post-heat treatment to obtain the aluminum-alloy shaped product, wherein crystallization products of the aluminum-alloy shaped product comprise eutectic Si, an intermetallic compound and their aggregates in the form of crystallization product networks, acicular crystallization products or crystallization product aggregates, and the aluminum-alloy shaped product having a eutectic Si area share of 8 to 18%, an average eutectic Si particle diameter of 1.5 to 4 μm, 25% or more of eutectic Si having an acicular eutectic Si ratio of a value of dividing a maximum length of the eutectic Si by a width of the eutectic Si orthogonal to the direction of the maximum length of 1.4 to 3, an intermetallic compound area share of 1.2 to 7.5% and an average intermetallic compound particle diameter of 1.5 to 4 μm; and (f) obtaining the aluminum-alloy shaped product exhibiting a tensile strength of 65 MPa or more and a fatigue strength of 40 MPa or more at a temperature of 300° C.

2. The method according to claim 1, wherein the aluminum alloy contains at least one species selected from among Sr in an amount of 0.003 to 0.03 mass %, Sb in an amount of 0.1 to 0.35 mass %, Na in an amount of 0.0005 to 0.015 mass % and Ca in an amount of 0.001 to 0.02 mass %.

3. The method according to claim 1, wherein the aluminum alloy contains the Mg in an amount of 0.5 to 1.3 mass %.

4. The method according to claim 1, wherein during the forging step, the percent reduction of a portion of the forging material that requires high-temperature fatigue strength resistance is regulated to 70% or less.

5. The method according to claim 1, wherein in the forging step, the heat treatment step is performed at a temperature of 380 to 480° C.

6. The method according to claim 1, wherein the continuously cast rod is produced through continuous casting of a molten aluminum alloy having an average temperature which falls within a range of a liquidus temperature +40° C. to the liquidus temperature +230° C. at a casting speed of 80 to 2,000 mm/minute.

7. The method according to claim 6, wherein the continuously cast rod is produced at a casting speed of 300 to 2,000 mm/minute.

* * * * *